US012479684B2

(12) United States Patent
Fan

(10) Patent No.: US 12,479,684 B2
(45) Date of Patent: Nov. 25, 2025

(54) TRANSFER ADHESIVE WHEEL DEVICE OF ONLINE ADHESIVE PASTING MECHANISM, CONTROL METHOD, ASSEMBLY AND MECHANISM

(71) Applicant: JIANGSU KATOP AUTOMATION CO., LTD., Jiangsu (CN)

(72) Inventor: Zhenhua Fan, Jiangsu (CN)

(73) Assignee: JIANGSU KATOP AUTOMATION CO., LTD., Jiangsu (CN)

( * ) Notice: Subject to any disclaimer, the term of this patent is extended or adjusted under 35 U.S.C. 154(b) by 427 days.

(21) Appl. No.: 18/011,098

(22) PCT Filed: Dec. 2, 2020

(86) PCT No.: PCT/CN2020/133456
§ 371 (c)(1),
(2) Date: Dec. 16, 2022

(87) PCT Pub. No.: WO2021/253739
PCT Pub. Date: Dec. 23, 2021

(65) Prior Publication Data

US 2023/0242365 A1 Aug. 3, 2023

(30) Foreign Application Priority Data

Jun. 18, 2020 (CN) ..... 202010560358.5

(51) Int. Cl.
*B65H 20/12* (2006.01)
*B65H 20/14* (2006.01)

(52) U.S. Cl.
CPC ..... *B65H 20/12* (2013.01); *B65H 20/14* (2013.01); *B65H 2406/15* (2013.01); *B65H 2701/377* (2013.01)

(58) Field of Classification Search
None
See application file for complete search history.

(56) References Cited

U.S. PATENT DOCUMENTS 6,547,229 B1 4/2003 Hanson et al.
2023/0352718 A1* 11/2023 Fan ..... H01M 10/052

FOREIGN PATENT DOCUMENTS

CN 203166029 U 8/2013
CN 109110545 A 1/2019
(Continued)

OTHER PUBLICATIONS

Chinese Patent Office Action for Application No. 202010560358.5 dated Nov. 23, 2024 (17 pages including Engish machine translation).

(Continued)

*Primary Examiner* — Christopher T Schatz
(74) *Attorney, Agent, or Firm* — Michael Best & Friedrich LLP

(57) ABSTRACT

Provided are a transfer tape wheel device of an on-line tape pasting mechanism, a control method, an assembly, and a mechanism. The transfer tape wheel device of the on-line tape pasting mechanism includes a transfer tape wheel shaft and multiple transfer tape wheels. Multiple vacuum holes and multiple compressed air holes are opened on a transfer tape wheel of the multiple transfer tape wheels from an inner side to an outer side of the transfer tape wheel. A vacuum interface and a compressed air interface are separately mounted on openings at two ends of the transfer tape wheel shaft. An in-shaft vacuum main line and an in-shaft compressed air main line are disposed in a hollow channel of the transfer tape wheel shaft.

17 Claims, 2 Drawing Sheets

(56) References Cited

FOREIGN PATENT DOCUMENTS

| | | | |
|---|---|---|---|
| CN | 109244520 | A | 1/2019 |
| CN | 111063928 | A | 4/2020 |
| CN | 111785984 | A | 10/2020 |
| CN | 213124498 | A | 5/2021 |
| JP | 2011147864 | A | 8/2011 |

OTHER PUBLICATIONS

Japanese Patent Office. Notifications of Reasons for Refusal for Application No. 2022-578640, dated Feb. 27, 2024 (10 pages with translation).
PCT/CN2020/133456 International Search Report dated Mar. 3, 2021.

* cited by examiner

TRANSFER ADHESIVE WHEEL DEVICE OF ONLINE ADHESIVE PASTING MECHANISM, CONTROL METHOD, ASSEMBLY AND MECHANISM

CROSS-REFERENCE TO RELATED APPLICATIONS

This is a National Stage Application filed under 35 U.S.C. 371 based on International Patent Application No. PCT/CN2020/133456, filed on Dec. 2, 2020, which claims priority to Chinese Patent Application No. 202010560358.5 filed on Jun. 18, 2020, disclosures of both of which are incorporated herein by reference in their entireties.

TECHNICAL FIELD

The present disclosure relates to the field of lithium battery processing and, in particular, to a transfer tape wheel device of an on-line tape pasting mechanism, a control method, an assembly, and a mechanism.

BACKGROUND

With the wide application of lithium batteries, a growing number of devices related to the production of lithium batteries come into being. To satisfy the requirements of society, the degree of automation of battery production enterprises is getting higher and higher, and various devices are becoming unmanned and intelligent.

In the production process of lithium batteries, two adjacent rolls of foil need to be spliced to achieve continuous winding. In the existing art, after the foil is automatically spliced, the strength of the splicing position is lower than that of other positions, so that the phenomenon of band breakage at the splicing position is easy to occur in the subsequent process, and thus the machining quality of the batteries is affected, a lot of labor and material resources are required for maintenance, and the production cost is high. Moreover, individual positions that need to be spliced are spliced by manual operation, and at this time, the processing equipment needs to shut down, thereby seriously reducing the production efficiency and further increasing the production cost.

For this reason, some enterprises have proposed new schemes. For example, Patent Application No. 2020100154594 discloses a technical scheme of an on-line tape pasting mechanism for a foil band movement direction. In the technical scheme, an on-line transfer tape pasting method is used for implementing high-efficiency and high-quality automatic tape pasting work. A transfer tape preparation roller has auxiliary functions of vacuum adsorption and vacuum breaking control, thereby improving the reliability of tape transfer. Basic functions of on-line tape pasting have good effects, the tape is bubble-free and wrinkle-free, and the quality of tape pasting is good.

However, in this technical scheme, a vacuum and vacuum breaking pipeline joint (including a vacuum generator and an electromagnetic valve for the vacuum breaking control) which generates vacuum and breaks the vacuum is mounted on a rotating shaft of a transfer assembly, resulting in the relatively large mass of the entire tape transfer assembly, especially, the rotating shaft of the transfer assembly, further resulting in large inertia of the rotating shaft of the tape transfer assembly during rotation, bringing in a negative effect on the starting, acceleration, and stopping of the tape transfer process. Thus, the transfer tape preparation roller has a poor dynamic control effect when working at a high speed, further limiting a speed of the on-line tape pasting. Therefore, there is room for further optimization of the overall technical scheme.

In view of this, an object of the present disclosure is to provide a new technical scheme to solve the existing technical defects.

SUMMARY

To overcome shortcomings of the existing art, the present disclosure provides a transfer tape wheel device of an on-line tape pasting mechanism, a control method, an assembly, and a mechanism, so as to solve the technical defects in the existing art such as large rotational inertia of a transfer tape wheel shaft, affecting the starting and acceleration performance, and reducing the tape pasting efficiency.

To solve technical problems, the present disclosure adopts the technical schemes described below.

A transfer tape wheel device of an on-line tape pasting mechanism includes a transfer tape wheel shaft having a hollow channel and multiple transfer tape wheels disposed on an outer side of the transfer tape wheel shaft, where multiple vacuum holes and multiple compressed air holes are opened on a transfer tape wheel of the multiple transfer tape wheels from an inner side to an outer side of the transfer tape wheel, a vacuum interface and a compressed air interface are separately mounted on openings at two ends of the transfer tape wheel shaft, an in-shaft vacuum main line and an in-shaft compressed air main line are disposed in the hollow channel of the transfer tape wheel shaft, the in-shaft vacuum main line and the in-shaft compressed air main line communicate with an inner end of the vacuum interface and an inner end of the compressed air interface, respectively, where the vacuum interface and the compressed air interface are disposed at a shaft end, the in-shaft vacuum main line communicates with the multiple vacuum holes on the transfer tape wheel through a vacuum manifold, and the in-shaft compressed air main line communicates with the multiple compressed air holes on the transfer tape wheel through a compressed air manifold.

As an improvement of the preceding technical scheme, the vacuum interface and the compressed air interface are both rotary joints, a vacuum or vacuum breaking operation is capable of being performed on the multiple vacuum holes on the transfer tape wheel through the vacuum interface, the in-shaft vacuum main line, and the vacuum manifold, and compressed air is capable of being applied to the multiple compressed air holes on the transfer tape wheel through the compressed air interface, the in-shaft compressed air main line, and the compressed air manifold.

As a further improvement of the preceding technical scheme, an annular cavity is provided inside the transfer tape wheel, where the multiple vacuum holes and the multiple compressed air holes communicate with the annular cavity, the vacuum manifold and the compressed air manifold both communicate with the annular cavity, an external connection position of the vacuum interface is connected to a vacuum generator through a pipeline, and an external connection position of the compressed air interface is connected to a compressed air valve system through a pipeline.

As a further improvement of the preceding technical scheme, the multiple vacuum holes and the multiple compressed air holes opened on the transfer tape wheel are centrosymmetrically distributed along an axial direction so as to ensure static balance and dynamic balance of the entire transfer tape wheel shaft, and the multiple vacuum holes and the multiple compressed air holes are universal holes.

As a further improvement of the preceding technical scheme, the vacuum manifold and the compressed air manifold are mounted in the hollow channel of the transfer tape wheel shaft and staggered along an axial direction in the hollow channel.

As a further improvement of the preceding technical scheme, along an access direction of the in-shaft vacuum main line from the vacuum interface, a last vacuum manifold is a two-way manifold or a three-way manifold and other vacuum manifolds are three-way manifolds, and along an access direction of the in-shaft compressed air main line from the compressed air interface, a last compressed air manifold is a two-way manifold or a three-way manifold and other compressed air manifolds are three-way manifolds.

A vacuum control method of the transfer tape wheel device of the on-line tape pasting mechanism is described below.

A vacuum is opened: the vacuum is opened when the transfer tape wheel is pressed down to a tape preparation plate and a first transfer operation of a tape is ready to be performed.

The vacuum is maintained: the transfer tape wheel maintains a vacuum function when the transfer tape wheel is lifted, stays in a middle, and is at a position of avoiding.

The vacuum is closed: after foil reaches a splicing position, when the transfer tape wheel is lifted and a second transfer of the tape is performed, the transfer tape wheel opens compressed air while the vacuum of the transfer tape wheel is closed.

The vacuum and compressed air are both closed after the second transfer of the tape to a product such as a foil band.

The operation control logic is repeated as before.

The present disclosure further provides a transfer tape pasting assembly of an on-line tape pasting mechanism. The transfer tape pasting assembly of the on-line tape pasting mechanism includes a transfer swing arm and a swing arm driver capable of driving the transfer swing arm to swing, where the transfer swing arm is provided with the preceding transfer tape wheel device of the on-line tape pasting mechanism and a rotary driver for driving the transfer tape wheel shaft and the transfer tape wheel to rotate.

Based on the preceding transfer tape pasting assembly of the on-line tape pasting mechanism, the present disclosure further provides an on-line tape pasting mechanism. The on-line tape pasting mechanism includes a rack and an unwinding assembly, a tape pulling assembly, a tape pasting assembly, and a tape preparation assembly mounted on the rack, where the rack is further provided with the transfer tape pasting assembly of the on-line tape pasting mechanism.

As an improvement of the preceding technical scheme, the transfer swing arm is mounted on the rack through a swing arm mounting shaft, the tape preparation assembly includes a tape preparation plate, a taped cylinder, and a taped head, the swing arm driver is a two-stage stroke drive cylinder, and the transfer swing arm is a two-stage stroke swing arm.

The present disclosure has the beneficial effects described below. The present disclosure provides a transfer tape wheel device of an on-line tape pasting mechanism, a control method, an assembly, and a mechanism. In the transfer tape wheel device of the on-line tape pasting mechanism, the control method, the assembly, and the mechanism, the vacuum interface and the compressed air interface are disposed at two ends of the hollow transfer tape wheel shaft, connection to the vacuum generator and the compressed air valve system is implemented through the vacuum interface and the compressed air interface, and the vacuum generator and the compressed air valve system may be mounted on the outer side of the transfer tape wheel shaft through the mounting structure, thereby effective reducing the mass of the transfer tape wheel shaft and rotational inertia of the transfer tape wheel shaft. Further, in a transfer tape pasting process, the starting, acceleration, deceleration, and stopping performance of the transfer tape wheel shaft and the transfer tape wheel is higher, the rotating and positioning are more rapid, the dynamic controllability during starting and high-speed working of the transfer tape wheel is achieved, and a matchable whole line connection speed of the on-line pasting is further improved, which is conducive to improving the tape pasting efficiency and accuracy.

To sum up, the transfer tape wheel device of the on-line tape pasting mechanism, the control method, the assembly, and the mechanism solve the technical defects in the existing art such as large rotational inertia of the transfer tape wheel shaft, affecting the starting and acceleration performance, and reducing the tape pasting efficiency.

BRIEF DESCRIPTION OF DRAWINGS

The present disclosure is further described below in conjunction with drawings and embodiments.

DETAILED DESCRIPTION

Figure 1:
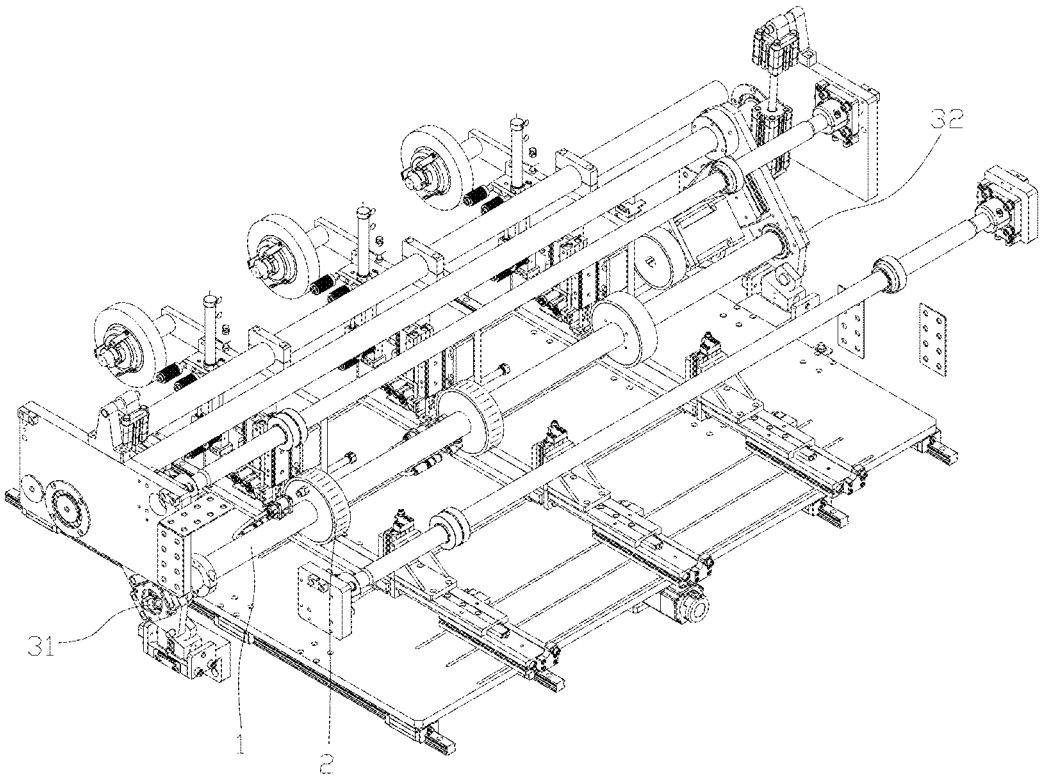
FIG. 1 is a schematic view illustrating the assembly of an on-line tape pasting mechanism according to the present disclosure.
Figure 2:
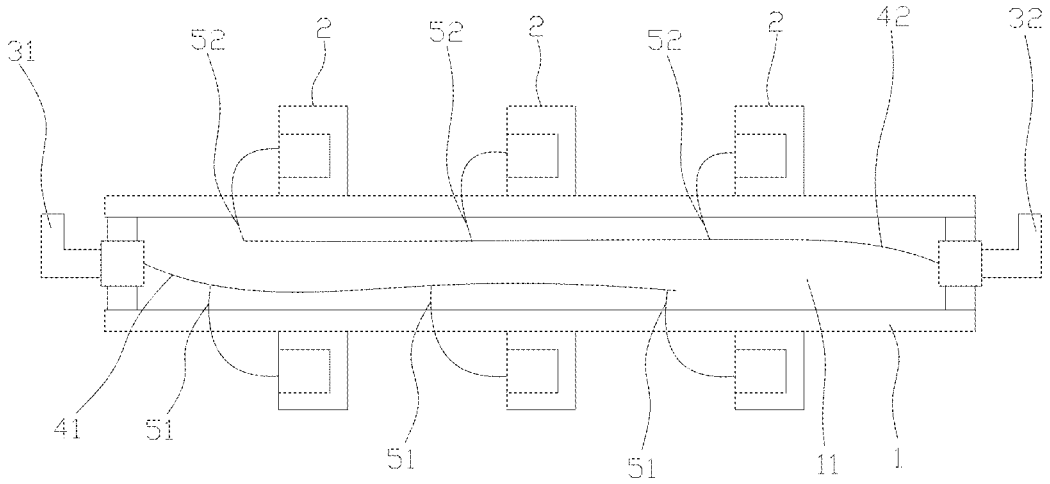
FIG. 2 is a schematic diagram illustrating an air path arrangement of a transfer tape wheel device of an on-line tape pasting mechanism according to the present disclosure.
Figure 3:
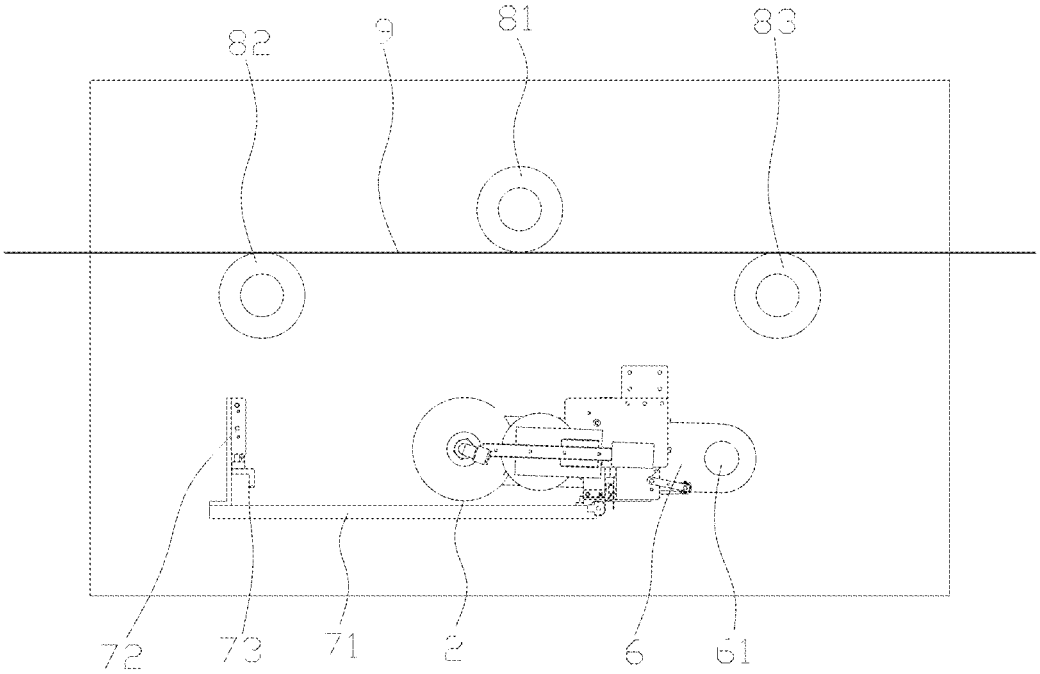
FIG. 3 is a schematic diagram illustrating a mechanism state during a first transfer of a tape according to the present disclosure.
Figure 4:
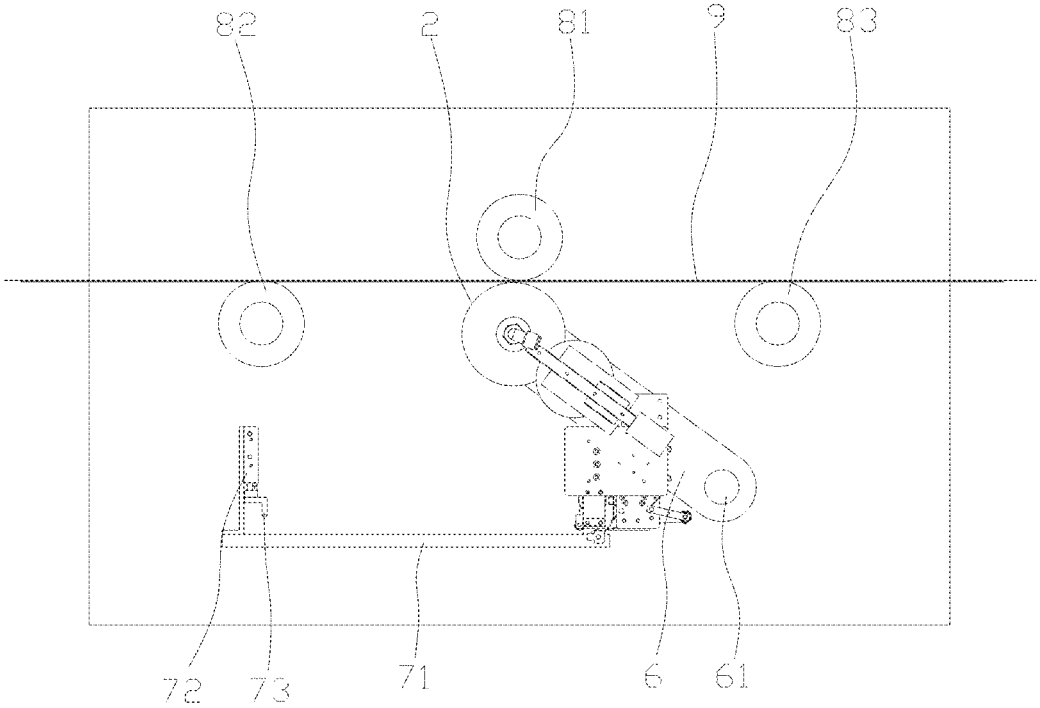
FIG. 4 is a schematic diagram illustrating a mechanism state during a second transfer of a tape according to the present disclosure.

A concept, a specific structure and technical effects of the present disclosure are clearly and completely described below in conjunction with the embodiments and drawings, so as to fully understand the object, feature and effects of the present disclosure. Apparently, the embodiments described herein are part, not all, of the embodiments of the present disclosure. Based on the embodiments of the present disclosure, other embodiments obtained by those skilled in the art on the premise that no creative work is done are within the scope of the present disclosure. In addition, all coupling/connection relationships involved in the patent do not mean that components are directly connected, but mean that according to a specific implementation, coupling accessories are added or reduced so as to compose a better coupling structure. Referring to FIGS. 1 to 4, various technical features in the present disclosure can be combined interactively on the premise of not contradicting each other.

A transfer tape wheel device of an on-line tape pasting mechanism includes a transfer tape wheel shaft 1 having a hollow channel 11 and multiple transfer tape wheels 2 disposed on an outer side of the transfer tape wheel shaft 1, where multiple vacuum holes and multiple compressed air holes are opened on a transfer tape wheel 2 of the multiple transfer tape wheels 2 from an inner side to an outer side of the transfer tape wheel 2, a vacuum interface 31 and a compressed air interface 32 are separately mounted on openings at two ends of the transfer tape wheel shaft 1, an in-shaft vacuum main line 41 and an in-shaft compressed air main line 42 are disposed in the hollow channel 11 of the transfer tape wheel shaft 1, the in-shaft vacuum main line 41 and the in-shaft compressed air main line 42 communicate with an inner end of the vacuum interface 31 and an inner end of the compressed air interface 32, respectively, where the vacuum interface 31 and the compressed air interface 32 are disposed at a shaft end, the in-shaft vacuum main line 41 communicates with the multiple vacuum holes on the transfer tape wheel 2 through a vacuum manifold 51, and the in-shaft compressed air main line 42 communicates with the multiple compressed air holes on the transfer tape wheel 2 through a compressed air manifold 52.

The vacuum interface 31 and the compressed air interface 32 are separately mounted at two ends of the transfer tape wheel shaft 1. Other devices, such as a vacuum generator, a vacuum control valve, a compressed air generator, and a compressed air valve system, may be mounted on the outer side of the transfer tape wheel shaft 1 through the vacuum interface 31 and the compressed air interface 32, thereby effectively reducing inertia of the transfer tape wheel shaft 1 and the transfer tape wheel 2 during rotation, which is conducive to improving the starting and acceleration performance of the transfer tape wheel shaft 1 and the transfer tape wheel 2 and improving the tape transfer efficiency. In this manner, the control accuracy is higher and the control speed is greater.

The vacuum holes and the compressed air holes are disposed on the transfer tape wheel 2, thereby implementing functions of vacuum, vacuum breaking, and compressed air delivery of the transfer tape wheel 2.

In an embodiment, the vacuum interface 31 and the compressed air interface 32 are both rotary joints, a vacuum or vacuum breaking operation is capable of being performed on the multiple vacuum holes on the transfer tape wheel 2 through the vacuum interface 31, the in-shaft vacuum main line 41, and the vacuum manifold 51, and compressed air is capable of being applied to the multiple compressed air holes on the transfer tape wheel 2 through the compressed air interface 32, the in-shaft compressed air main line 42, and the compressed air manifold 52.

The vacuum interface 31, the in-shaft vacuum main line 41, and the vacuum manifold 51 cooperate with the vacuum holes on the transfer tape wheel 2 to form a vacuum pipeline of the transfer tape wheel device of the on-line tape pasting mechanism, and the compressed air interface 32, the in-shaft compressed air main line 41, and the compressed air manifold 51 cooperate with the compressed air holes on the transfer tape wheel 2 to form a compressed air pipeline of the transfer tape wheel device of the on-line tape pasting mechanism.

The vacuum and vacuum breaking operation may be performed on the vacuum holes on the transfer tape wheel 2 through the vacuum pipeline, and the compressed air may be blown to the compressed air holes on the transfer tape wheel 2 through the compressed air pipeline.

The transfer tape wheel device of the on-line tape pasting mechanism opens the vacuum and vacuum breaking on the vacuum holes on the transfer tape wheel 2 through the vacuum pipeline, and the transfer tape wheel device of the on-line tape pasting mechanism delivers the compressed air to the compressed air holes on the transfer tape wheel 2 through the compressed air pipeline.

In an embodiment, an annular cavity 21 is provided inside the transfer tape wheel 2, where the multiple vacuum holes and the multiple compressed air holes communicate with the annular cavity 21, the vacuum manifold 51 and the compressed air manifold 52 both communicate with the annular cavity 21, an external connection position of the vacuum interface 31 is connected to a vacuum generator through a pipeline, and an external connection position of the compressed air interface 32 is connected to a compressed air valve system through a pipeline. With this structure, some components with relatively large mass, such as the vacuum generator, the vacuum control valve, the compressed air generator, and the compressed air valve system, may be mounted on the outer side of the transfer tape wheel shaft 1 without being mounted on the transfer tape wheel shaft 1, thereby reducing the moment of inertia of the transfer tape wheel shaft 1.

In an embodiment, the multiple vacuum holes and the multiple compressed air holes opened on the transfer tape wheel 1 are centrosymmetrically distributed along an axial direction so as to ensure static balance and dynamic balance of the entire transfer tape wheel shaft 1. In an embodiment, the vacuum holes and the compressed air holes are uniformly distributed in series along an outer circumferential edge of the transfer tape wheel 2, and the vacuum holes and the compressed air holes are centrosymmetrically distributed, thereby greatly improving the static balance and the dynamic balance of the transfer tape wheel shaft 1 and the transfer tape wheel 2, which is conducive to improving the stability of a first transfer of a tape and a second transfer of the tape and indirectly improving the tape pasting quality. In this embodiment, the multiple vacuum holes and the multiple compressed air holes are universal holes.

In an embodiment, vacuum manifolds 51 and compressed air manifolds 52 are mounted in the hollow channel 11 of the transfer tape wheel shaft 1 and staggered along an axial direction in the hollow channel 11. With a staggered distribution of the mounting structure, on the one hand, all the vacuum manifolds 51 and the compressed air manifolds 52 can be accommodated in the hollow channel 11 of the transfer tape wheel shaft 1, and on the other hand, the dynamic balance and the static balance of the transfer tape wheel shaft 1 can be improved.

In an embodiment, along an access direction of the in-shaft vacuum main line 41 from the vacuum interface 31, a last vacuum manifold 51 is a two-way manifold or a three-way manifold and other vacuum manifolds 51 are three-way manifolds, and along an access direction of the in-shaft compressed air main line 42 from the compressed air interface 32, a last compressed air manifold 52 is a two-way manifold or a three-way manifold and other compressed air manifolds 52 are three-way manifolds. In the specific implementation, an implementer may select suitable vacuum manifolds 51 and compressed air manifolds 52 according to specific requirements.

Based on the preceding transfer tape wheel device of the on-line tape pasting mechanism, the present disclosure further provides a vacuum control method of the transfer tape wheel device of the on-line tape pasting mechanism. The control method includes the steps described below.

A vacuum is opened: the vacuum is opened when the transfer tape wheel 2 is pressed down to a tape preparation plate 71 and a first transfer operation of a tape is ready to be performed.

The vacuum is maintained: the transfer tape wheel 2 maintains a vacuum function when the transfer tape wheel 2 is lifted, stays in a middle, and is at a position of avoiding.

The vacuum is closed: after foil 9 reaches a splicing position, when the transfer tape wheel 2 is lifted and a second transfer of the tape is performed, the transfer tape wheel 2 opens compressed air while the vacuum of the transfer tape wheel 2 is closed.

The vacuum and compressed air are both closed after the second transfer of the tape to a product such as a foil band 9.

The operation control logic is repeated as before, thereby achieving automated on-line tape pasting.

Based on the preceding transfer tape wheel device of the on-line tape pasting mechanism, the present disclosure further provides a transfer tape pasting assembly of an on-line tape pasting mechanism. The transfer tape pasting assembly of the on-line tape pasting mechanism includes a transfer swing arm 6 and a swing arm driver capable of driving the transfer swing arm 6 to swing, where the transfer swing arm 6 is provided with the preceding transfer tape wheel device of the on-line tape pasting mechanism and a rotary driver for driving the transfer tape wheel shaft 1 and the transfer tape wheel 2 to rotate.

Based on the preceding transfer tape pasting assembly of the on-line tape pasting mechanism, the present disclosure further provides an on-line tape pasting mechanism. The on-line tape pasting mechanism includes a rack and an unwinding assembly, a tape pulling assembly, a tape pasting assembly, and a tape preparation assembly mounted on the rack, where the rack is further provided with the transfer tape pasting assembly of the on-line tape pasting mechanism.

In an embodiment, the transfer swing arm 6 is mounted on the rack through a swing arm mounting shaft 61, the tape preparation assembly includes a tape preparation plate 71, a taped cylinder 72, and a taped head 73, the swing arm driver is a two-stage stroke drive cylinder, and the transfer swing arm 6 is a two-stage stroke swing arm.

When the preceding technical schemes are specifically implemented, a process of transferring the tape from the tape preparation plate 71 to the transfer tape wheel 2 is a first transfer process of the tape, and a process of transferring the tape from the transfer tape wheel 2 to the foil 9 is a second transfer process of the tape. Control logics of the vacuum pipeline and the compressed air pipeline of the transfer tape wheel device of the on-line tape pasting mechanism are described below.

A vacuum is opened: the vacuum is opened when the transfer tape wheel 2 is pressed down to a tape preparation plate 71 and a first transfer operation of a tape is ready to be performed.

The vacuum is maintained: the transfer tape wheel 2 always maintains a vacuum function when the transfer tape wheel 2 is lifted, stays in a middle, and is at a position of avoiding.

The vacuum is closed: after a product such as foil 9 reaches a splicing position, when the transfer tape wheel 2 is lifted and a second transfer of the tape is performed, the transfer tape wheel 2 opens compressed air and breaks the vacuum while the vacuum of the transfer tape wheel 2 is closed.

In an embodiment, when the vacuum is opened, the swing arm driver drives the transfer swing arm 6 to swing and causes the transfer tape wheel 2 to be pressed down on the tape preparation plate 71. When the tape is ready for the first transfer process, with the cooperation and operation of the corresponding vacuum generator and vacuum control valve, the vacuum interface 31 generates the vacuum on the vacuum holes of the transfer tape wheel 2 through the in-shaft vacuum main line 41 and the vacuum manifold 51, and then the tape prepared on the tape preparation plate 71 is adsorbed and transferred onto the transfer tape wheel 2 using the vacuum generated by the vacuum holes, so as to complete the first transfer of the tape. In an embodiment, referring to FIG. 3, the transfer tape wheel shaft 1 and the transfer tape wheel 2 are both at a low position, and a lower edge of the transfer tape wheel 2 abuts against the tape preparation plate 71.

When the vacuum is maintained, the swing arm driver drives the swing arm 6 to swing upwards, and the transfer tape wheel shaft 1 and the transfer tape wheel 2 are lifted upwards. During a lifting process, in processes of stopping and the position of avoiding in the middle, the vacuum function of the vacuum holes on the transfer tape wheel 2 is maintained, and the tape is always vacuum-absorbed on the transfer tape wheel 2. More specifically, after the first transfer process of the tape and before the second transfer of the tape, the vacuum function of the transfer tape wheel device of the on-line tape pasting mechanism is always maintained.

When the vacuum is closed, the foil 9 is delivered to the splicing position by a corresponding delivery device. At this time, the swing arm driver drives the transfer swing arm 6 to swing and lifts the transfer tape wheel 2, and the transfer tape wheel 2 transfers the tape adsorbed on a surface of the transfer tape wheel 2 to the splicing position of the foil 9. This process is the second transfer process of the tape. When the second transfer of the tape is performed, the corresponding vacuum generator and vacuum control valve cooperate to turn off the vacuum function on the transfer tape wheel. At the same time, the corresponding compressed air generator and compressed air valve system cooperate to work and open the compressed air on the transfer tape wheel 2, and the compressed air from the outside passes through the compressed air interface 32, the in-shaft compressed air main line 42, and the compressed air manifold 52 and is ejected from the compressed air holes on the transfer tape wheel 2. The compressed air is used for vacuum breaking so that the second transfer process of the tape is successfully completed. In an embodiment, referring to FIG. 4, both the transfer tape wheel shaft 1 and the transfer tape wheel 2 are lifted to a high position, and the foil 9 moves to a splicing and tape pasting position under the guidance of a front idler roller 82, a rear idler roller 83, and a tape pasting back roller 81. When the second transfer is performed, the transfer tape wheel 2 abuts the foil 9 against a lower edge of the tape pasting back roller 81 and transfers the tape on the transfer tape wheel 2 onto the foil 9 through cooperation.

After the second transfer of the tape is completed, the tape is transferred onto the foil 9. At this time, the vacuum and the compressed air on the transfer tape wheel 2 are both closed, and an on-line tape pasting process on the foil 9 is completed.

The preceding operations are repeated so that the tape can be continuously transferred to the foil 9, thereby achieving automation.

The above is a specific description of preferred embodiments of the present disclosure. However, the present disclosure is not limited to the embodiments. Various equivalent modifications or alterations may further be made by those skilled in the art without departing from the spirit of the present disclosure. These equivalent modifications or alterations fall within the scope of the claims in the present application.

What is claimed is:

1. A transfer tape wheel device of an on-line tape pasting mechanism, comprising a transfer tape wheel shaft having a hollow channel and a plurality of transfer tape wheels disposed on an outer side of the transfer tape wheel shaft, wherein a plurality of vacuum holes and a plurality of compressed air holes are opened on a transfer tape wheel of the plurality of transfer tape wheels from an inner side to an outer side of the transfer tape wheel, a vacuum interface and a compressed air interface are separately mounted on openings at two ends of the transfer tape wheel shaft, an in-shaft vacuum main line and an in-shaft compressed air main line are disposed in the hollow channel of the transfer tape wheel shaft, the in-shaft vacuum main line and the in-shaft compressed air main line communicate with an inner end of the vacuum interface and an inner end of the compressed air interface, respectively, the in-shaft vacuum main line communicates with the plurality of vacuum holes on the transfer tape wheel through a vacuum manifold, and the in-shaft compressed air main line communicates with the plurality of compressed air holes on the transfer tape wheel through a compressed air manifold.

2. The transfer tape wheel device of the on-line tape pasting mechanism of claim 1, wherein the vacuum interface and the compressed air interface are both rotary joints, a vacuum is capable of being applied to the plurality of vacuum holes on the transfer tape wheel through the vacuum interface, the in-shaft vacuum main line, and the vacuum manifold, and compressed air is capable of being applied to the plurality of compressed air holes on the transfer tape wheel through the compressed air interface, the in-shaft compressed air main line, and the compressed air manifold and the vacuum is capable of being broken.

3. The transfer tape wheel device of the on-line tape pasting mechanism of claim 1, wherein an annular cavity is provided inside the transfer tape wheel, wherein the plurality of vacuum holes and the plurality of compressed air holes both communicate with the annular cavity, the vacuum manifold and the compressed air manifold both communicate with the annular cavity, an external connection position of the vacuum interface is connected to a vacuum generator through a vacuum pipeline, and an external connection position of the compressed air interface is connected to a compressed air valve system through a compressed air pipeline.

4. The transfer tape wheel device of the on-line tape pasting mechanism of claim 1, wherein the plurality of vacuum holes and the plurality of compressed air holes opened on the transfer tape wheel are centrosymmetrically distributed along an axial direction.

5. The transfer tape wheel device of the on-line tape pasting mechanism of claim 1, wherein the vacuum manifold and the compressed air manifold are mounted in the hollow channel of the transfer tape wheel shaft and staggered along an axial direction in the hollow channel.

6. A vacuum control method using a transfer tape wheel device of an on-line tape pasting mechanism, comprising:

opening a vacuum: opening the vacuum when the transfer tape wheel is pressed down to a tape preparation plate and a first transfer operation of a tape is ready to be performed;

maintaining the vacuum: maintaining, by the transfer tape wheel, function of the vacuum before a foil reaches a splicing position and when the transfer tape wheel is lifted; and closing the vacuum: after the foil reaches the splicing position, when the transfer tape wheel is lifted and a second transfer of the tape is performed, opening, by the transfer tape wheel, compressed air while the vacuum of the transfer tape wheel is closed;

wherein the transfer tape wheel device of the on-line tape pasting mechanism comprises a transfer tape wheel shaft having a hollow channel and wherein the transfer tape wheel is included among a plurality of transfer tape wheels disposed on an outer side of the transfer tape wheel shaft, wherein a plurality of vacuum holes and a plurality of compressed air holes are opened on the transfer tape wheel of the plurality of transfer tape wheels from an inner side to an outer side of the transfer tape wheel, a vacuum interface and a compressed air interface are separately mounted on openings at two ends of the transfer tape wheel shaft, an in-shaft vacuum main line and an in-shaft compressed air main line are disposed in the hollow channel of the transfer tape wheel shaft, the in-shaft vacuum main line and the in-shaft compressed air main line communicate with an inner end of the vacuum interface and an inner end of the compressed air interface, respectively, the in-shaft vacuum main line communicates with the plurality of vacuum holes on the transfer tape wheel through a vacuum manifold, and the in-shaft compressed air main line communicates with the plurality of compressed air holes on the transfer tape wheel through a compressed air manifold.

7. A transfer tape pasting assembly of an on-line tape pasting mechanism, comprising a transfer swing arm and a swing arm driver capable of driving the transfer swing arm to swing, wherein the transfer swing arm is provided with a transfer tape wheel device of the on-line tape pasting mechanism and a rotary driver;

wherein the transfer tape wheel device of the on-line tape pasting mechanism comprises a transfer tape wheel shaft having a hollow channel and wherein the transfer tape wheel is included among a plurality of transfer tape wheels disposed on an outer side of the transfer tape wheel shaft, wherein a plurality of vacuum holes and a plurality of compressed air holes are opened on the transfer tape wheel of the plurality of transfer tape wheels from an inner side to an outer side of the transfer tape wheel, a vacuum interface and a compressed air interface are separately mounted on openings at two ends of the transfer tape wheel shaft, an in-shaft vacuum main line and an in-shaft compressed air main line are disposed in the hollow channel of the transfer tape wheel shaft, the in-shaft vacuum main line and the in-shaft compressed air man line communicate with an inner end of the vacuum interface and an inner end of the compressed air interface, respectively, the in-shaft vacuum main line communicates with the plurality of vacuum holes on the transfer tape wheel through a vacuum manifold, and the in-shaft compressed air main line communicates with the plurality of compressed air holes on the transfer tape wheel through a compressed air manifold;

wherein the rotary driver is configured to drive the transfer tape wheel shaft and the transfer tape wheel to rotate.

8. An on-line tape pasting mechanism, comprising a rack and an unwinding assembly, a glue pulling assembly, a glue pasting assembly, and a glue preparation assembly mounted on the rack, wherein the rack is further provided with the transfer tape pasting assembly of the on-line tape pasting mechanism of claim 7.

9. The on-line tape pasting mechanism of claim 8, wherein the transfer swing arm is mounted on the rack through a swing arm mounting shaft, the tape preparation assembly comprises a tape preparation plate, a taped cylinder, and a taped head, the swing arm driver is a two-stage stroke drive cylinder, and the transfer swing arm is a two-stage stroke swing arm.

10. The vacuum control method of claim 6, wherein the vacuum interface and the compressed air interface are both rotary joints, the vacuum is capable of being applied to the plurality of vacuum holes on the transfer tape wheel through the vacuum interface, the in-shaft vacuum main line, and the vacuum manifold, and the compressed air is capable of being applied to the plurality of compressed air holes on the transfer tape wheel through the compressed air interface, the in-shaft compressed air main line, and the compressed air manifold, and the vacuum is capable of being broken.

11. The vacuum control method of claim 6, wherein an annular cavity is provided inside the transfer tape wheel, wherein the plurality of vacuum holes and the plurality of compressed air holes both communicate with the annular cavity, the vacuum manifold and the compressed air manifold both communicate with the annular cavity, an external connection position of the vacuum interface is connected to a vacuum generator through a vacuum pipeline, and an external connection position of the compressed air interface is connected to a compressed air valve system through a compressed air pipeline.

12. The vacuum control method of claim 6, wherein the plurality of vacuum holes and the plurality of compressed air holes opened on the transfer tape wheel are centrosymmetrically distributed along an axial direction.

13. The vacuum control method of claim 6, wherein the vacuum manifold and the compressed air manifold are mounted in the hollow channel of the transfer tape wheel shaft and staggered along an axial direction in the hollow channel.

14. The transfer tape pasting assembly of an on-line tape pasting mechanism of claim 7, wherein the vacuum interface and the compressed air interface are both rotary joints, a vacuum is capable of being applied to the plurality of vacuum holes on the transfer tape wheel through the vacuum interface, the in-shaft vacuum main line, and the vacuum manifold, and compressed air is capable of being applied to the plurality of compressed air holes on the transfer tape wheel through the compressed air interface, the in-shaft compressed air main line, and the compressed air manifold and the vacuum is capable of being broken.

15. The transfer tape pasting assembly of an on-line tape pasting mechanism of claim 7, wherein an annular cavity is provided inside the transfer tape wheel, wherein the plurality of vacuum holes and the plurality of compressed air holes both communicate with the annular cavity, the vacuum manifold and the compressed air manifold both communicate with the annular cavity, an external connection position of the vacuum interface is connected to a vacuum generator through a vacuum pipeline, and an external connection position of the compressed air interface is connected to a compressed air valve system through a compressed air pipeline.

16. The transfer tape pasting assembly of an on-line tape pasting mechanism of claim 7, wherein the plurality of vacuum holes and the plurality of compressed air holes opened on the transfer tape wheel are centrosymmetrically distributed along an axial direction.

17. The transfer tape pasting assembly of an on-line tape pasting mechanism of claim 7, wherein the vacuum manifold and the compressed air manifold are mounted in the hollow channel of the transfer tape wheel shaft and staggered along an axial direction in the hollow channel.

* * * * *